US009387483B2

(12) United States Patent
Duma

(10) Patent No.: US 9,387,483 B2
(45) Date of Patent: Jul. 12, 2016

(54) MECHANICAL PROCESSING OF OIL SANDS

(75) Inventor: Thomas Duma, Alberta (CA)

(73) Assignee: Cryoex Oil Ltd., Calgary (CA)

( * ) Notice: Subject to any disclaimer, the term of this patent is extended or adjusted under 35 U.S.C. 154(b) by 0 days.

(21) Appl. No.: 13/579,276

(22) PCT Filed: Feb. 14, 2011

(86) PCT No.: PCT/CA2011/050087

§ 371 (c)(1),
(2), (4) Date: Aug. 15, 2012

(87) PCT Pub. No.: WO2011/097735

PCT Pub. Date: Aug. 18, 2011

(65) Prior Publication Data

US 2012/0312723 A1 Dec. 13, 2012

Related U.S. Application Data

(60) Provisional application No. 61/304,728, filed on Feb. 15, 2010.

(51) Int. Cl.

| | |
|---|---|
| ***C10G 1/04*** | (2006.01) |
| ***B03B 9/02*** | (2006.01) |
| ***B03B 1/00*** | (2006.01) |
| ***C10G 1/00*** | (2006.01) |

(52) U.S. Cl.
CPC ... *B03B 9/02* (2013.01); *B03B 1/00* (2013.01); *C10G 1/00* (2013.01)

(58) Field of Classification Search
CPC ..... C10G 1/00; B03B 1/00; B03B 9/02; B02C 11/08
USPC ..... 208/390, 402, 409, 424, 426; 241/17, 241/23, 24.1; 209/7
See application file for complete search history.

(56) References Cited

U.S. PATENT DOCUMENTS

| | | | | |
|---|---|---|---|---|
| 2,301,595 | A | 11/1942 | Washburn | |
| 2,965,557 | A | 12/1960 | Price | |
| 3,114,694 | A * | 12/1963 | Bergougnou et al. | 208/390 |
| 3,487,002 | A * | 12/1969 | Chaney et al. | 208/426 |
| 3,560,371 | A | 2/1971 | Kaminsky | |
| 3,993,555 | A | 11/1976 | Park | |

(Continued)

FOREIGN PATENT DOCUMENTS

GB 2 073 048 A 10/1981

OTHER PUBLICATIONS

M.N. Rahaman, Ceramic Processing and Sintering, Section 2.4, pp. 52-62 (2003).*

(Continued)

*Primary Examiner* — Prem C Singh
*Assistant Examiner* — Brandi M Doyle
(74) *Attorney, Agent, or Firm* — Christensen O'Connor Johnson Kindness PLLC

(57) ABSTRACT

A method of extracting bitumen from oil sands having a transition temperature at which the oil sands solidify includes forming formable oil sands into pellets and cooling at least a surface of the pellets sufficiently to prevent the pellets from aggregating; cooling the pellets to below the transition temperature; fracturing the pellets to release the bitumen from the oil sands while maintaining the temperature of the pellets below the transition temperature; and separating the bitumen from the oil sands in a separator.

42 Claims, 3 Drawing Sheets

(56) References Cited

U.S. PATENT DOCUMENTS

| | | | | |
|---|---|---|---|---|
| 4,110,195 | A | | 8/1978 | Hardin |
| 4,151,067 | A | | 4/1979 | Grow |
| 4,250,017 | A | | 2/1981 | Reale |
| 4,443,322 | A | | 4/1984 | Jubenville |
| 4,486,294 | A | | 12/1984 | Miller |
| 4,498,971 | A | * | 2/1985 | Angelov et al. ..... 208/390 |
| 4,721,256 | A | * | 1/1988 | Lyman ..... 241/1 |
| 4,946,597 | A | | 8/1990 | Sury |
| 2008/0035531 | A1 | | 2/2008 | Coveley |

OTHER PUBLICATIONS

International Search Report mailed Apr. 20, 2011, issued in corresponding International Application No. PCT/CA2011/050087, filed Feb. 14, 2011, 4 pages.

International Preliminary Report on Patentability mailed Jun. 4, 2012, issued in corresponding International Application No. PCT/CA2011/050087, filed Feb. 14, 2011, 3 pages.

* cited by examiner

MECHANICAL PROCESSING OF OIL SANDS

FIELD

This relates to a mechanical process for processing oil sands that pelletizes mined oil sands.

BACKGROUND

The traditional method of extracting bitumen from mined oil sands involves hot water, solvents and usually chemical additives. The resultant slurry is agitated, and the bitumen froth is skimmed from the top.

Using water in the extraction process creates significant environmental problems. Waterless systems have been proposed, such as are described in U.S. Pat. No. 3,114,694 (Bergougnou et al.) entitled "Process for the recovery of bitumen from tar sands utilizing a cooling technique" and U.S. Pat. No. 4,498,971 (Angelov et al.) entitled "Separation of bituminous material from oil sands and heavy crude oil."

Furthermore, when oil sands are mined, it is common to have large pockets or lenses of clay in the mined material, which are introduced into the stream of material being processed. The efficiency of the process is affected by the ratio of bitumen to other materials, such as sand and clay.

SUMMARY

According to an aspect, there is provided a method of extracting bitumen from oil sands having a transition temperature below which the oil sands fracture under stress. The method comprises the steps of: forming formable oil sands into pellets and cooling at least a surface of the pellets sufficiently to prevent the pellets from aggregating; cooling the pellets to below the transition temperature; fracturing the pellets to release the bitumen from the oil sands while maintaining the temperature of the pellets below the transition temperature; and separating the bitumen from the oil sands in a separator.

At least the surface of the pellets may be cooled to a temperature of less than −25° F. to prevent aggregation. Cooling at least a surface of the pellets may comprise passing the pellets through a cooling tower. The pellets may be further cooled in a fluidized bed at the bottom of the cooling tower.

The pellets may have a volume less than 1 $cm^3$, and may be substantially uniform.

The pellets may be cooled to a temperature of less than −40° F. In one aspect the pellets may be cooled to a temperature of less than −100° F. or −125° F. prior to being fractured. The cooled pellets may be stored below a temperature at which the pellets aggregate prior to fracturing.

Separating the bitumen from the oil sands may comprise using at least one of a solid/gas separator, a solid/liquid separator, and an electrostatic separator, using at least a cyclone separator and/or may comprises depositing the bitumen and oil sands into a fluid having a specific gravity that is greater than bitumen and less than oil sands.

Fracturing the bitumen from the oil sands may comprise more than one fracturing stage or may comprise using at least one of a ball mill, a hammer mill, a rod mill, a roller mill, a buhrstone mill, a vertical shaft impactor mill, or combination thereof. Fracturing the pellets may comprise reducing the oil sands to the size of an average sand particle in the oil sands. The separated bitumen may contain fines.

According to another aspect, there is provided an apparatus for extracting bitumen from oil sands having a transition temperature below which the oil sands fracture under stress.

The apparatus has a pelletizer having a pelletizing section that forms the formable oil sands into pellets, and a cooling section that receives the pellets from the pelletizing section and cools at least a surface of the pellets sufficiently to prevent the pellets from aggregating. There is a cooling module that cools the pellets below the transition temperature. There is a fracturing section that fractures the cooled pellets into a fractured product containing bitumen particles. There is a separator that separates the bitumen particles from the fractured product. The cooling module maintains the oil sands at a temperature below the transition temperature in the fracturing section and the separator.

The pelletizer may be a pelletizing tower. The pelletizing section may comprise a perforated plate and at least one roller, where the roller presses the oil sands through the perforated plate. The cooling section may comprise a cooling tower and a fluidized bed that receives the pellets from the cooling tower. There may be a cold storage unit that stores the cooled pellets below a temperature at which the pellets aggregate prior to the fracturing section.

The fracturing section may comprise at least one of a ball mill, a hammer mill, a rod mill, a roller mill, a buhrstone mill, a vertical shaft impactor mill, or combination thereof. The fracturing section may comprise more than one fracturing stage.

The cooling module may cool the pellets below −40° F., −100° F. or −125° F. prior to the fracturing section.

The separator may comprise at least one of a solid/gas separator, a solid/liquid separator, and an electrostatic separator, may comprise at least a cyclone separator, or may comprise a tank filed with a fluid having a specific gravity that is greater than bitumen and less than oil sands.

According to another aspect, there is provided a method of separating non-oil sand substances and oil sands in extracted material. The method comprises the steps of: forming the extracted material into substantially uniform pellets and cooling at least a surface of the pellets sufficiently to prevent the pellets from aggregating; stratifying the pellets in a fluidized bed according to specific gravities; and removing pellets having a desired specific gravity from the fluidized bed. Pellets of clay may be removed from the fluidized bed.

According to another aspect, there is provided an apparatus for separating non-oil sand substances and oil sands in extracted material. The apparatus has a pelletizer comprising a pelletizing section that forms the extracted material into substantially uniform pellets and a cooling section that cools at least a surface of the pellets sufficiently to prevent the pellets from aggregating. A fluidized bed receives the pellets from the pelletizer. Pellet outlets allow pellets having a desired specific gravity to be extracted from the fluidized bed. At least one pellet outlet may be used for extracting clay pellets.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

In the discussion herein, there will be described a mechanical process that may be used to improve the processing of oil sands. This process may be used to separate bitumen from sand and clay in oil sands, or to extract certain materials from the mined oil sands prior to further processing, whether it be water-based or mechanical. The term "oil sands", also referred to as tar sands or extra heavy oil, refers to a type of bitumen deposit that is made up of bitumen, sand and clay. While oil sands will be discussed with reference to bitumen, sand and claim, other components may also be present, such as various minerals and water. The characteristics of any specific type of oil sands will depend on the relative content of the various components. There may be undesired contaminants on three levels: in the mined material, in the oil sands, and in the bitumen itself.

In addition to the oil sands, the composition of the mined material will include other materials, such as clay, sand, rock, organic material, etc. This may be referred to herein as "non-oil sand substances," which is intended to refer to compositions of matter that do not include bitumen. For simplicity, the term "clay" will be used herein to refer to these non-oil sand substances, although it will be understood that other substances, such as sand, rock organic material, etc. may also be present. These other materials adversely affect the bitumen recovery process as well as the disposal of by-products as the same resources that are applied to extracting bitumen from oil sand particles must also be applied to them. The oil sands, or the bitumen-containing component of the mined material will also be a composition of bitumen, clay, sand and other particles. The oil sands must be processed to extract the bitumen, and one option for extracting the bitumen will be discussed below. Finally, the bitumen itself may contain fine particles of clay and other minerals.

According to one aspect, the process discussed herein allows a user to extract bitumen from the mined oil sands using mechanical fracturing and separation steps. The fracturing and separation steps are generally concerned with separating bitumen from the sand and clay in the oil sands, and not with the separation of the fines from the bitumen. According to another aspect, the process also allows a user to remove some components that do not have bitumen from the mined material, such as the organic material and clay.

Figure 4:
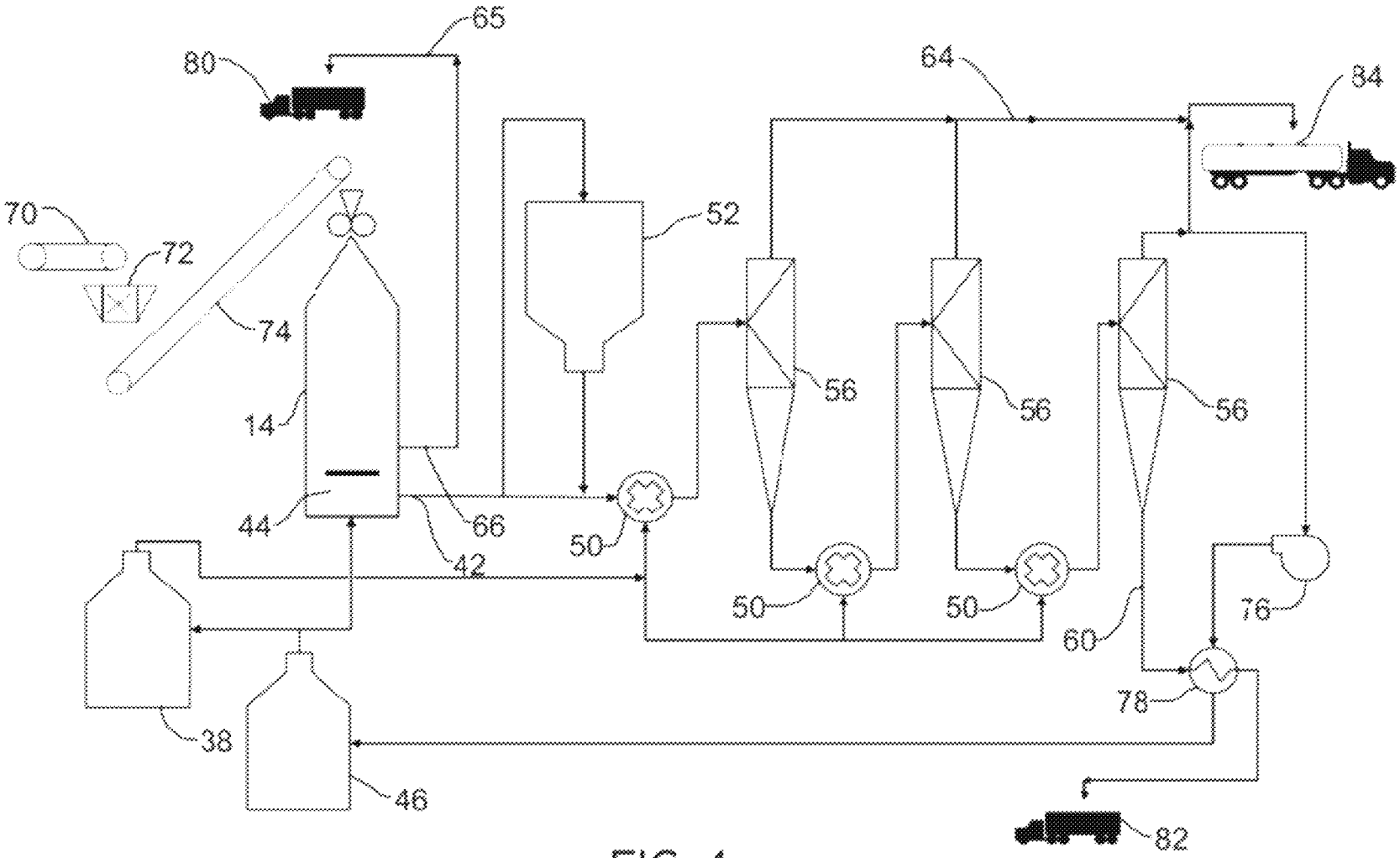
FIG. 4 is another schematic of an apparatus for separating bitumen from oil sands.

Before oil sands are processed, they should be pre-processed to remove any large rocks, roots, or other contaminants to allow the apparatus to work more efficiently. This pre-processing stage may also include some milling to reduce the size of certain components to a manageable size. Referring to FIG. 4, this stage is represented by conveyor 70 and crusher 72. As this process is well known in the art, it will not be described further.

Figure 1:
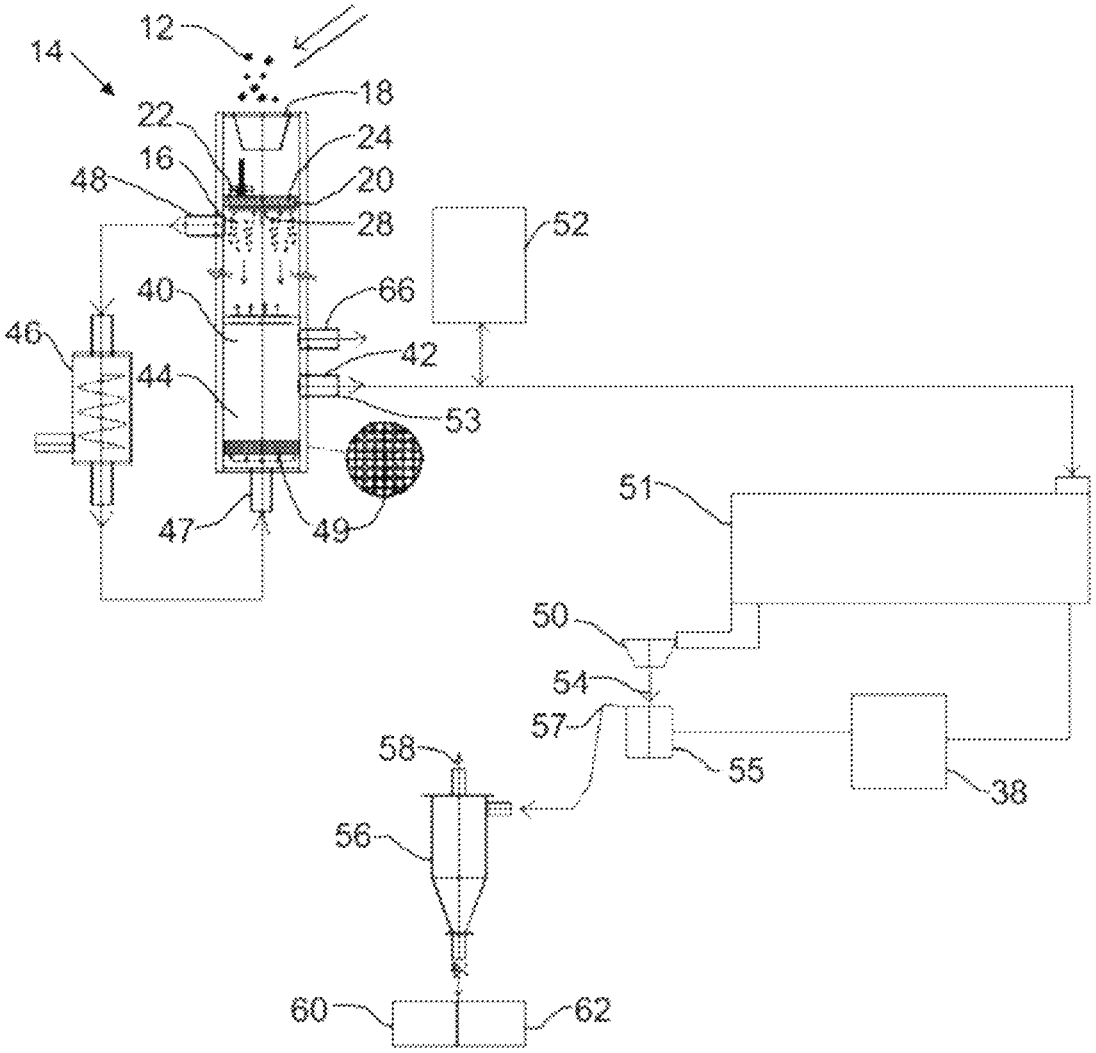
FIG. 1 is a schematic of an apparatus for separating bitumen from oil sands.

Referring to FIG. 1, the process of separating bitumen from oil sands begins by forming the mined material 12, a significant portion of which is oil sands, into pellets 16. This is done while the oil sand content of mined material 12 is formable, or capable of being molded, pressed or otherwise formed into a solid object. This state may also be referred to as being malleable or friable. In general, it has been found that oil sands are sufficiently formable for the described embodiment when they are at a temperature of 50° F. to 60° F., which is also commonly the temperature of mined oil sands when they are removed from the ground. As will be apparent, the temperature at which this occurs may vary depending on the specific oil sands being mined, and also may depend on the manner in which pellets 16 are formed. Generally speaking, the characteristics of the oil sands will depend primarily on the bitumen content. At higher temperatures, the oil sands become more fluid and therefore more difficult to form into pellets that hold their shape. At lower temperatures, the oil sands adhere more readily to equipment, and ultimately begin to act more like a solid, which also makes it more difficult to form into pellets. The temperature in this range does not have as significant of an effect on clay or other materials that may be present.

In the depicted embodiment, mined material 12 is formed into pellets 16 by introducing mined material 12 into a pelletizing tower 14. As used herein, pelletizing is generally used to describe a process of forming mined oil sands into pellets. The process uses formable oil sands that are then formed into the desired size and shape. Preferably, pellets 16 are substantially the same size, and have a volume that is less than 1 $cm^3$ although it is expected that some variations in the size of pellets is likely to occur. Accordingly, the pellets may be described as "substantially uniform", with 60% or more of the pellets being within 10-20% of the target size. The size of the pellets will depend primarily on the preferences of the user and the equipment being used, either to form the pellets, cool the pellets, or to process the pellets after forming. While two examples are described below, it will be understood that many different pelletizing processes are known that may be suitably adapted to pelletize the mined material. Furthermore, it will be understood that the actual size may be larger than 1 $cm^3$, and that the shape may not be cylindrical. The size and shape will depend at least in part on the equipment used to produce the pellets.

Figure 2:
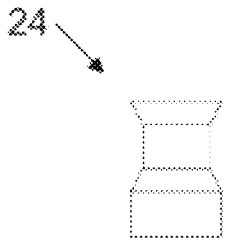
FIG. 2 is a detailed side elevation view in section of a hole in a pelletizing plate.

Referring to FIG. 1, mined material 12 is fed into an inlet 18 at the top of pelletizing tower 14, where they are deposited onto a perforated disk 20. A pre-processing step may occur prior to this (not shown) that removes large objects such as rocks, roots, etc. Rollers 22 press mined material 12 into holes 24 in perforated disk 20, and mined material emerges from the bottom of disk 20 in a string form, which is formed into individual pellets 16 by a cutting member 28 that rotates below perforated disk 20. The speed at which cutting member 28 rotates may be adjusted to vary the length of pellets 16. When using this method, mined material 12 should be fed onto perforated disk 20 at a rate that optimizes the production of pellets without plugging holes 24. In FIG. 2, a detailed view in section of a hole 24 in perforated disk 20 is shown. This pelletizing method is most effective when there is a slight restriction in each hole 24 that opens afterward. This allows oil sands to be compressed together without bridging, in which holes 24 become plugged. It will also be noted that holes 24 must be spaced close enough to prevent a build up of mined material 12 between holes 24 that is not able to be pressed by rollers 22 into holes 24, and that perforated disk 20 must be thick enough to withstand the pressure of rollers 22. Rollers 22 may also be used to crush any parts of mined material 12 that remain after the pre-processing.

Figure 3:
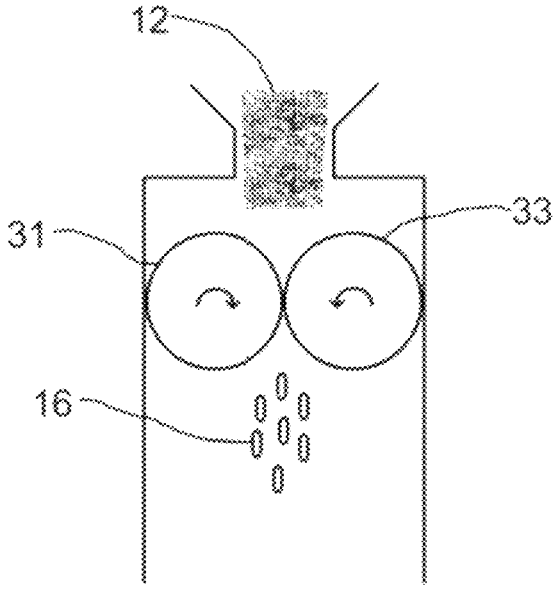
FIG. 3 is a detailed side elevation view in section of an alternate pelletizer.

In another example for forming pellets 16 shown in FIG. 3, two horizontal rollers 31 and 33 may be used. At least one of the rollers 31 and 33 has indentations to form the pellets. The other roller presses the oil sands into the indentations as they are fed from above. The pellets 16 are then ejected from the indentations into the pelletizing tower. The pellets may be ejected by an actuator, which may be an arm that is electrically actuated or that has one end that rotates about an eccentric axle within the roller to push the pellets out as the indentations reach the bottom of the rotation. Preferably, the pellet-forming equipment should be capable of sealing the top of the tower in order to allow the tower to be pressurized with cold gas, if that is used. Other pelletizing techniques involving rollers are also known in the art.

Once formed, pellets 16, or at least the surface of pellets 16, are cooled sufficiently to prevent them from aggregating with other pellets. The oil sands will then no longer be formable or malleable, and will no longer readily adhere to other substances. Thus, the oil sands are formed into pellets 16 when they are formable, and the pellets 16 are then cooled sufficiently to prevent them from aggregating with other pellets 16. It has been found that this occurs around −25° F. for some oil sands compositions, although it is preferred to have a lower target temperature, such as −40° F., as this allows some room for error if the pellets were to warm unexpectedly, uniform cooling does not occur, or the composition of the oil sands varies. It will be understood that the pellets may be sufficiently cooled for this purpose if the surface temperature of pellets 16 is sufficiently cooled, as the pellets 16 may then be stored together. While pellets made primarily from clay have little chance of aggregating with other pellets, all pellets will, of necessity, be cooled equally. The pellets may need to be cooled further in order to be below the threshold or transition temperature at which the oil sands become fracturable when placed under stress. Thus, there are two purposes to cooling the pellets: first, to prevent the pellets from aggregating at the pellet-forming stage, and second, to allow the pellets to be fractured at the bitumen-extraction stage. In some processes, only one cooling step may be required if it is sufficient to meet both purposes, or if the bitumen will be extracted using a different approach.

It will be recognized that the size and shape of pellets 16 will affect the speed at which cooling occurs. For example, shapes with a higher surface area to volume ratio, such as a prism with a crescent cross-section, are preferred to cool pellets 16 more quickly. The possible shapes of pellets 16 may be limited by the pelletizing equipment used to form them. The size of pellets 16 will also have an effect on the fluidized bed, where the amount of pressure relates to the amount of fluid pressure required to fluidize the bed. In a preferred embodiment, the fluid pressure is preferably from a cold nitrogen gas, although other gases or liquids could also be used. The size and shape of pellets 16 will also impact the fracturing stage discussed below. Generally speaking, pellets 16 should be substantially uniform in size within some margin of error, which allows the fracturing to occur more efficiently and also allows the necessary cooling times to be calculated. A uniform pellet size also assists in striating the pellets into layers based on their composition more precisely, which is particularly important if pellets composed of clay are to be removed.

In the depicted embodiment, pellets 16 are cooled individually by having them fall through a cooling section 40 of pelletizing tower 14, where they are subjected to an updraft of cold gases as the gases are circulated between inlet 47 and outlet 48. The height of tower 14 will depend on the amount of time required to cool pellets 16. By sealing the pelletizing portion, it allows a positive pressure of cold gases to be used, which can then be drawn off and recycled or released. In a preferred embodiment, pellets 16 fall into a fluidized bed 44 at the bottom of cooling section 40 in pelletizing tower 14, where pellets 16 are allowed to cool to the desired temperature before being drawn off, for example through outlets 42 or 66. As depicted, a cooling module 46 provides cold gases to tower 14 at a gas inlet 47, which then distributes the gas through a diffuser plate 49. Cooling module 46 may be a refrigeration plant that cools nitrogen extracted from air or dehydrated air, or it may use gases exhausted from other components that have colder target temperatures, in particular, if cold milling of pellets 16 follows. Alternatively, it may be a storage container that stores cooled gases for use as needed. The actual source of cold gases may vary depending on the final design, however refrigeration plant 46 preferably allows for some control over the volume and temperature of the cold gases to allow for optimization of pelletizing tower 14. As depicted in FIG. 4, there is a cooling module 46 that provides cold nitrogen gas to tower 14 and fluidized bed 44, and a cooling module 38 that provides liquid nitrogen to mills 50.

A fluidized bed is formed when the pellets are placed under appropriate conditions to cause the solid/fluid mixture to behave as a fluid, such as the ability to free-flow under gravity, to separate into striated layers based on density or weight, and to be pumped using fluid type technologies. It will be understood that, in this context, a "fluid" may be a liquid or a gas. In the preferred embodiment described herein, fluidized bed 44 is formed by introducing a cold gas, such as nitrogen, below fluidized bed 44 with sufficient pressure to cause pellets 16 to behave as a fluid.

Particularly where pellets 16 are cold milled, it is preferred that the cold energy present in the process be used efficiently through the use of heat exchangers, and recycled or redirected gas. The final design to make use of the cold energy will depend on the target temperatures at each stage, whether the pellets are further cooled for cold milling, and final design of the apparatus. As depicted, cooling module 46 receives cold temperatures from a heat exchanger 78 at the end of the milling process, which helps recapture some cold energy from the milling products. Cooling module 46 may also provide some cold gas to cooling module 38 to help improve the efficiency of storing or producing of liquid nitrogen.

Referring to FIG. 1, gas inlet 47 is located at the bottom of tower 14 and provides cold gases at a sufficient rate and pressure to have pellets 16 behave like a fluid in fluidized bed 44. These injected gases also create an updraft of cold gases up through tower 14 as they circulate between inlet 47 and outlet 48. The gases may then be recooled by a cooling module 46 as shown.

In order to achieve the desired cooling of pellets 16 in tower 14, nitrogen gas may be used as it is readily available and is inert with respect to bitumen. In one example, the temperature of the nitrogen gas was around −25° F. when removed from gas outlet 48, and around −80° F. when entering through gas inlet 47. It will be understood that the actual temperatures will depend on the size and rate that pellets 16 are formed, the target temperature, the rate of gas flow, the heat capacity of the gas used, and the time that pellets 16 are in tower 14, including the time in fluidized bed 44 as well as the time it takes to fall through cooling section 40.

In the embodiment discussed above, cold gases are circulated through tower 14 to cool pellets 16. It will be understood that other cold fluids may be used with suitable modifications. If liquids are used, it may be necessary to separate the liquid or flash it off after pellets 16 have been removed from fluidized bed 44 and before proceeding to the fracturing stage. Furthermore, the liquid used, as with the gas, should be inert with respect to bitumen.

Pellets 16 are held in fluidized bed 44 until they are drawn off for further processing. Prior to being drawn off, fluidized bed 44 allows the unwanted materials, such as clay, to be removed prior to processing. Once pellets 16 are located in fluidized bed 44, pellets 16 may be made to separate according to their density, such that those pellets 16 that are primarily clay will separate from the other oil sands pellets 16. This allows them to be removed, such as from outlet 66. Other outlets may also be included to remove pellets at various desired levels in fluidized bed 44. Even if pellets 16 are ultimately processed in a traditional water-based system to recover the bitumen, this technique may be useful to remove excess clay or other components that do not contain bitumen in order to reduce the clay content in the material that is treated. It will be understood that the density of each pellet will not correspond to the bulk density of the fluidized bed, which will, of necessity, be less than the density of each pellet to maintain fluidity. While the density of each pellet will vary depending on its composition, the bulk density of the bed will change depending on the overall composition of the pelletized product as well as the size and shape of the pellets.

It will be understood that the removal of clay pellets 16 will result in a more efficient process for extracting bitumen. As an example, there will now be described a method of processing pellets 16 after clay pellets 16 have been removed. This will emphasize the benefit of not having to process excess clay, which cannot yield any bitumen, but must be processed the same as pellets containing bitumen.

From the fluidized bed, the pellets may be subjected to a mechanical process to separate bitumen from oil sands. In general, the process begins by forming oil sands into pellets that are substantially the same size and cooling them to reduce their tendency to adhere to other pellets such that they will remain as distinct units and not aggregate throughout the process as described above. During the fracturing and separation steps, it is important to maintain the temperature of the bitumen and the oil sands below a transition temperature at which the bitumen in the oil sands are able to be fractured when placed under stress, such as in a mill. The process may require that the oil sands be cooled well below this transition temperature in anticipation of heat being generated during, for example, milling. In addition, there may be a particular target temperature below this threshold at which desirable characteristics are obtained, such as an optimal temperature to fracture the bitumen from the oil sands. The embodiment shown in the drawings and discussed herein relates to a test apparatus that was designed to process small batches of oil sands. It will be understood that similar principles embodied in this test equipment may be used on a commercial scale.

Referring to FIG. 1, pellets are preferably drawn from outlet 42 and transferred to a fracturing apparatus, such as a cold mill 50. Pellets may be transferred directly from tower 14, or pellets 16 may be transferred from a cold storage area 52 where they are deposited from tower 14. Pellets 16 are removed from tower 14 using an air lock valve 53 to prevent the loss of pressure in tower 14. As shown, pellets 16 pass through a cooling chamber 51 connected to cooling module 38 that cools pellets 16 to the target temperature for mill 50. Cooling fluid in fluidized bed 44 may be used to ensure pellets do not aggregate, while cooling module 38 cools pellets 16 below the transition temperature at which pellets 16 will fracture under the applied stress un the fracturing stage. In some embodiments, these functions may be done simultaneously, where cooling module 38 cools pellets 16 sufficiently for fracturing in fluidized bed 44.

During fracturing, pellets 16 are crushed to very fine particles in order to separate the bitumen from the oil sands. As used herein, fracturing refers to any technique that applies a force to break the mechanical bonds between particles, either between different particles, such as the bond between bitumen and sand, or internal bonds, such as the bonds within the sand. The fracturing will ideally target the bonds between the bitumen and other particles, as breaking internal bonds increases the amount of energy required and generates more heat.

In one embodiment, favourable results were obtained using a cold mill 50 from Pulva Corporation of Saxonburg, Pa. although other types of fracturers may be used, such as grinders, crushers, pulverisers, ball mills, rod mills, grinding rolls, etc. that are capable of operating at the required temperatures as will be recognized by those in the art.

When fracturing oil sands, it should be kept in mind that oil sands may be water-wet, e.g. oil sands with hydrophilic sand grains, or oil-wet, e.g. oil sands with hydrophobic sand grains. In water-wet oil sands, a thin film of water separates the sand grains from the bitumen. In oil-wet oil sands, the bitumen contacts the sand grain directly. In the oil sands deposits around Fort McMurray, Alberta, the oil sands are primarily water-wet, but may also be oil-wet. Using the traditional water-based system, the bitumen is more easily released from water-wet oil sands than from oil-wet sand grains. With respect to fracturing at low temperatures, both types can be processed although bitumen is also more easily released from water-wet oil sand. As the water freezes at low temperatures, it is believed to form a relatively weak barrier between the bitumen and the sand grain that is broken during milling. In oil-wet oil sands, the bitumen is bonded directly to the sand grain, which may require additional milling or force to break the bonds.

While maintaining pellets 16 below their transition temperature, they are fed into cold mill 50. As heat is generated during milling, it may be necessary to cool pellets 16 well below the nominal temperature of −40° F. prior to milling. A cooling module 38 is shown that provide cooling to mill 50 and to the milled product collector 55. The amount of cooling will depend on the amount of milling forces applied, and the amount of cooling available during milling. Suitable results have been obtained by cooling pellets 16 to below −100° F. or preferably −150° F. prior to milling, and then applying cooling during milling as well. It is also important that the milled product 54 is maintained below the transition temperature after milling to prevent the bitumen particles from agglomerating with other particles. Cooling module 38 may take various forms, such as a refrigeration plant, a storage container that stores cooled fluids for use as needed, etc. and may be formed in separate components, as long as it is able to provide sufficient cooling. In the test example, cooling module 38 was a liquid nitrogen tank with a regulator.

While it is important to maintain an appropriate temperature to keep the bitumen and oil sands in a solid form, the temperature also affects how the pellets fracture. Ideally, the temperature will be selected to enhance the fracturing between bitumen and the other particles in the oil sands. For example, bitumen may have a temperature below which the bitumen fractures more easily. Upon reaching this temperature, it may then be possible to apply a sufficient fracturing force to break the bitumen, but not crush the sand unnecessarily.

In a preferred embodiment, multiple stages, such as three stages, are used to fracture pellets 16. This would also increase processing capacity. Each stage may use a different type of fracturer, depending on the preferences of the user and the efficiencies of each type of fracturer. If necessary, milled pellets 54 may be reintroduced into mill 50 to further break down the particles and improve the amount of bitumen recovered, or additional stages may be included. Pellets 16 are preferably reduced to the size of the sand particles in the oil sands, such as around 200 μm for oil sands in the Fort McMurray, Alberta area. However, milling will continue until bitumen particles are separated from the sand and clay particles to the desired level, which may require the particles to be reduced even smaller.

Once sufficiently milled, the milled product 54 is introduced into a separator to separate the bitumen particles from the sand and clay. This may be done in various ways, as will be recognized by those skilled in the art. One example includes an air separator, where the milled product 54 is circulated in a cyclone separator 56, which causes lighter particles to rise above heavier particles. As clay particles will be very small, they may be lighter than bitumen and sand, and clay 62 may first be removed in a first separator stage as shown in FIG. 4, after which bitumen particles 58 can be captured for further processing in later separator stages. The actual separation technique may vary as discussed below. Furthermore, while sand 60 and clay 62 are described as being removed separately, this may not be the case, as the main purpose is simply to remove and collect bitumen 58.

It has been found that the outlet gas created by the cooling module 38 injecting liquid nitrogen prior to and during milling carries off a significant portion of bitumen particles. Thus, while the milled product 54 is collected in collector 55, the vent 57 of collector is fed into cyclone separator 56, or otherwise filtered out of the outlet cooling gases. Milled product 54 that is not carried through vent 57 may be reintroduced into mill 50, introduced into another mill (not shown), or may be subject to a different separation technique.

While only a single separator 56 is shown, it will be understood that separation may occur in stages, and may use different separation techniques at each stage, such as a physical filter or an electrostatic filter to separate bitumen particles from the gas stream. Another example of a separator (not shown) may be to mix the milled product in a liquid that has a specific gravity between bitumen and the other components and is a liquid at the temperatures being used, such as glycol. Bitumen 58 will then float on the liquid while sand 60 and clay 62 sink to the bottom, allowing bitumen 58 to be drawn off for further processing. As will be understood by those skilled in the art, the specific gravity of bitumen will depend upon its composition, including the amount and type of fines contained in the bitumen, which may affect the liquid being selected.

Once bitumen particles 58 are separated from the sand and clay, it is no longer necessary to maintain the cold temperatures, although it may be preferred to do so for ease of handling until they are ready to be transported to the upgrader facilities to be processed.

It will be recognized that the process described above is not intended to remove the fines that are present in the separated bitumen. This is also the case with the more traditional hot water process, where fines are carried in the bitumen froth at the end of the process. The processes to remove these fines are known in the art, and will not be described further.

Referring to FIG. 4, a schematic of another process to extract bitumen is shown. As stated above, the process begins by feeding extracted material containing oil sands along conveyor 70 into a crusher 72. This is generally representative of the pre-processing steps necessary to place the mined material into a suitable form. From crusher 72, the pre-processed material is fed by conveyor 74 into pelletizing tower 14, which forms the oil sands into pellets from and cools them as they fall through tower 14 into fluidized bed 44 to prevent them from aggregating. As shown, there may be multiple outlets for the pellets of different compositions. For example, there may be outlets 42 and 66 as shown. In fluidized bed 44, the pellets will form stratified layers based on their specific gravity. In this example, outlet 66 removes clay pellets by line 65, which may then be disposed of, such as by transport truck 80. This reduces the amount of material to cool and to mill. In addition, as the presence of clay in water-based processes can increase the difficulties associated with bitumen recovery and the disposal of by-products these problems may be reduced by removing a significant portion of the clay before water is added.

Referring to still FIG. 4, outlet 42 removes pellets that are to be milled, which will generally be a mixture of bitumen, sand and clay. As shown, outlet 42 leads to a mill 50, or other device used to fracture pellets 16. The milled product continues to other mills 50, such that pellets 16 are milled in stages, rather than in a single pass. Mills 50 preferably get progressively finer to improve the efficiency of the mills and bitumen recovery. As shown, after each mill 50, separators 56 are used to separate bitumen from sand and clay, with the bitumen passing out the top of separators 56 along a bitumen capture line 64 as shown. It will be understood that some separators may be used to remove clay and/or sand to increase the bitumen concentration, while others may be used to remove bitumen before additional milling occurs. If cyclone separators are used as depicted, it is necessary to maintain sufficient pressure in the process. This requirement is represented by fan 76, although the pressure may also be applied from cooling module 46. Preferably, the cold energy is recaptured to enhance the efficiency of the process, which is represented by heat exchanger 78. As shown, the end products are collected as sand and clay (represented by truck 82) and bitumen (represented by truck 84).

As mentioned above, pellets 16 are held in a fluidized bed 44 until they are drawn off for milling, and fluidized bed 44 may also play another role in removing some unwanted materials, such as clay, from the oil sands prior to processing. When oil sands 12 are mined, it is common to have large pockets or lenses of clay in the mined material. While the amount of clay adversely affects the bitumen recovery and disposal of byproduycts, it is difficult to remove this material prior to processing. As the mined product is pelletized in the process described above, there will be some pellets that are primarily clay formed along with pellets that are primarily oil sands. Once pellets 16 are located in fluidized bed 44, pellets 16 will separate according to their density, such that those pellets 16 that are primarily clay will separate from the other oil sands pellets 16, and can then be removed, such as from outlet 66. Other outlets may also be included to remove pellets at various desired levels in fluidized bed 44. Even if pellets 16 are ultimately processed in a traditional water-based system to recover the bitumen, this technique may be useful to remove excess clay or other components that do not contain bitumen in order to reduce the clay content in the material that is treated. It will be understood that the density of each pellet will not correspond to the bulk density of the fluidized bed, which will, of necessity, be less than the density of each pellet. While the density of each pellet will vary depending on its composition, the bulk density of the bed will change depending on the overall composition of the pelletized product as well as the size and shape of the pellets.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims.

The illustrated embodiments have been set forth only as examples and should not be taken as limiting the invention. It is to be understood that, within the scope of the following claims, the invention may be practiced other than as specifically illustrated and described.

What is claimed is:

1. A method of extracting bitumen from oil sands, the oil sands having a transition temperature below which the oil sands fracture under stress, the method comprising the steps of:

removing non-moldable material from mined oil sands to obtain moldable oil sands from the mined oil sands;

applying a compression force to form the moldable oil sands into pellets and maintaining a separation between the pellets while cooling at least a surface of the pellets sufficiently to prevent the pellets from aggregating;

cooling the pellets to below the transition temperature;

fracturing the pellets to release the bitumen from the oil sands while maintaining the temperature of the pellets below the transition temperature; and separating the bitumen from the oil sands in a separator.

2. The method of claim 1, wherein at least the surface of the pellets are cooled to a temperature of less than −25° F.

3. The method of claim 1, wherein cooling at least a surface of the pellets comprises causing the pellets to fall through a cooling tower.

4. The method of claim 3, wherein the pellets are further cooled in a fluidized bed at the bottom of the cooling tower.

5. The method of claim 1, wherein the pellets have a volume less than 1 $cm^3$.

6. The method of claim 1, wherein the pellets are substantially uniform.

7. The method of claim 1, wherein the pellets are cooled to a temperature of less than −40° F.

8. The method of claim 1, wherein the pellets are cooled to a temperature of less than −125° F. prior to being fractured.

9. The method of claim 1, comprising the step of storing the cooled pellets below a temperature at which the pellets aggregate prior to fracturing.

10. The method of claim 1, wherein separating the bitumen from the oil sands comprises using at least one of a solid/gas separator, a solid/liquid separator, and an electrostatic separator.

11. The method of claim 1, wherein separating the bitumen from the oil sands comprises using at least a cyclone separator.

12. The method of claim 1, wherein separating the bitumen from the oil sands comprises depositing the bitumen and oil sands into a fluid having a specific gravity that is greater than bitumen and less than oil sands.

13. The method of claim 1, wherein fracturing the pellets to release the bitumen from the oil sands comprises more than one fracturing stage.

14. The method of claim 1, wherein the separated bitumen contains fines.

15. The method of claim 1, wherein fracturing the pellets comprises using at least one of a ball mill, a hammer mill, a rod mill, a roller mill, a buhrstone mill, a vertical shaft impactor mill, or combination thereof.

16. The method of claim 1, wherein fracturing the pellets comprises reducing the oil sands to the size of an average sand particle in the oil sands.

17. The method of claim 1, wherein the oil sands are water-wet.

18. The method of claim 1, wherein the oil sands are oil-wet.

19. The method of claim 1, wherein cooling the pellets and separating the bitumen from the oil sands in a separator each comprises using an inert fluid.

20. The method of claim 1, wherein forming the moldable oil sands into pellets comprises compressing the oil sands into a die.

21. The method of claim 1, wherein the moldable oil sands are malleable.

22. A method of separating non-oil sand substances and oil sands comprising the steps of:

removing non-moldable material from mined oil sands to obtain moldable material from the mined oil sands that is capable of being pelletized by compression, the extracted material comprising oil sands and non-oil sands;

compressing the moldable material to form substantially uniform pellets and maintaining a separation between the pellets while cooling at least a surface of the pellets sufficiently to prevent the pellets comprising oil sands from aggregating;

stratifying the pellets in a fluidized bed according to specific gravities; and removing pellets having a desired specific gravity from the fluidized bed.

23. The method of claim 22, wherein the non-oil sand substances comprise at least one of clay and organic material.

24. The method of claim 22, wherein pellets of clay are removed from the fluidized bed.

25. The method of claim 22, wherein at least the surface of the pellets are cooled to a temperature of less than −25° F.

26. The method of claim 22, wherein cooling at least a surface of the pellets comprises passing the pellets through a cooling tower.

27. The method of claim 26, wherein the pellets are further cooled in the fluidized bed at the bottom of the cooling tower.

28. The method of claim 22, wherein the pellets have a volume less than 1 $cm^3$.

29. The method of claim 22, wherein the pellets are cooled to a temperature of less than −40° F.

30. The method of claim 22, further comprising the steps of:

collecting pellets to be fractured, at least a portion of which are pellets comprising oil sands;

cooling the pellets to be fractured below a transition temperature below which the oil sands fracture under stress;

fracturing the pellets to be fractured to release bitumen from the oil sands while maintaining the temperature of the fractured pellets below a transition temperature; and separating the bitumen from the oil sands in a separator.

31. The method of claim 30, wherein the pellets to be fractured are cooled to a temperature of less than −125° F. prior to being fractured.

32. The method of claim 30, comprising the step of storing the cooled pellets to be fractured below a temperature at which the pellets to be fractured aggregate prior to fracturing.

33. The method of claim 30, wherein separating the bitumen from the oil sands comprises using at least one of a solid/gas separator, a solid/liquid separator, and an electrostatic separator.

34. The method of claim 30, wherein separating the bitumen from the oil stands comprises using at least a cyclone separator.

35. The method of claim 30, wherein separating the bitumen from the oil sands comprises depositing the bitumen and oil sands into a fluid having a specific gravity that is greater than bitumen and less than oil sands.

36. The method of claim 30, wherein fracturing the pellets to be fractured to release the bitumen from the oil sands comprises more than one fracturing stage.

37. The method of claim 30, wherein the separated bitumen contains fines.

38. The method of claim 30, wherein fracturing the pellets to be fractured comprises using at least one of a ball mill, a hammer mill, a rod mill, a roller mill, a buhrstone mill, a vertical shaft impactor mill, or combination thereof.

39. The method of claim 30, wherein fracturing the pellets to be fractured comprises reducing the oil sands to the size of an average sand particle in the oil sands.

40. The method of claim 30, wherein the oil sands are water-wet.

41. The method of claim 30, wherein the oil sands are oil-wet.

42. The method of claim 30, wherein cooling the pellets and separating the bitumen from the oil sands in a separator each comprises using inert fluids.

* * * * *